US010704358B2

(12) United States Patent
Roessler et al.

(10) Patent No.: US 10,704,358 B2
(45) Date of Patent: Jul. 7, 2020

(54) DEVICE AND METHOD FOR OPENING AND STOPPING A TOE VALVE

(71) Applicant: GEODYNAMICS, INC., Millsap, TX (US)

(72) Inventors: Dennis Roessler, Ft. Worth, TX (US); John Hardesty, Fort Worth, TX (US); Kevin George, Cleburne, TX (US)

(73) Assignee: GEODYNAMICS, INC., Millsap, TX (US)

( * ) Notice: Subject to any disclaimer, the term of this patent is extended or adjusted under 35 U.S.C. 154(b) by 36 days.

(21) Appl. No.: 16/106,095

(22) Filed: Aug. 21, 2018

(65) Prior Publication Data

US 2019/0136664 A1 May 9, 2019

Related U.S. Application Data

(62) Division of application No. 16/105,144, filed on Aug. 20, 2018.

(60) Provisional application No. 62/582,561, filed on Nov. 7, 2017.

(51) Int. Cl.

| | |
|---|---|
| ***E21B 34/06*** | (2006.01) |
| ***E21B 34/14*** | (2006.01) |
| ***E21B 17/046*** | (2006.01) |
| *E21B 34/00* | (2006.01) |

(52) U.S. Cl.

CPC ..... *E21B 34/063* (2013.01); *E21B 17/046* (2013.01); *E21B 34/14* (2013.01); *E21B 2034/007* (2013.01)

(58) Field of Classification Search

CPC ..... E21B 34/063; E21B 17/046; E21B 34/14; E21B 2034/007

See application file for complete search history.

(56) References Cited

U.S. PATENT DOCUMENTS

| | | | |
|---|---|---|---|
| 4,951,753 | A | 8/1990 | Eriksen |
| 8,267,178 | B1 | 9/2012 | Sommers et al. |
| 2002/0060096 | A1 | 5/2002 | Brunnert et al. |
| 2007/0246265 | A1 | 10/2007 | deBoer |
| 2012/0111574 | A1 | 5/2012 | Desranleau et al. |
| 2013/0056206 | A1 | 3/2013 | Jackson et al. |
| 2014/0048271 | A1 | 2/2014 | Coon et al. |

(Continued)

OTHER PUBLICATIONS

International Search Report and Written Opinion of the International Searching Authority (Forms PCT/ISA/220, PCT/ISA/210 and PCT/ISA/237), dated Jan. 29, 2019, for related International Application No. PCT/US 18/47051.

*Primary Examiner* — Brad Harcourt

(74) *Attorney, Agent, or Firm* — Patent Portfolio Builders PLLC

(57) ABSTRACT

A downhole tool for connecting an interior of a casing to a formation, the downhole tool including an inner housing extending along a longitudinal axis X; an outer housing that encloses the inner housing and forms first to fourth chambers; a first piston that separates the first and second chambers; a second piston that separates the third and fourth chambers; a port that is configured to fluidly communicate an outside and inside of the downhole tool; and a stopping mechanism that prevents the second piston from opening the port. The second piston is positioned to separate the port into an outer portion and an inner portion to interrupt a fluid communication between the outside and inside of the downhole tool.

23 Claims, 13 Drawing Sheets

(56) References Cited

U.S. PATENT DOCUMENTS

| | | | | |
|---|---|---|---|---|
| 2014/0083689 | A1* | 3/2014 | Streich | E21B 34/063 166/250.15 |
| 2015/0369009 | A1 | 12/2015 | George | |
| 2016/0208578 | A1 | 7/2016 | Guzman et al. | |
| 2018/0163508 | A1 | 6/2018 | Kellner | |
| 2019/0136663 | A1* | 5/2019 | Roessler | E21B 17/046 |

* cited by examiner

DEVICE AND METHOD FOR OPENING AND STOPPING A TOE VALVE

CROSS-REFERENCE TO RELATED APPLICATIONS

This application is a divisional of U.S. patent application Ser. No. 16/105,144, filed Aug. 20, 2018, which is related to, and claims priority from, U.S. Provisional Patent Application Ser. No. 62/582,561 filed Nov. 7, 2017, entitled "DEVICE AND METHOD FOR STOPPING AND STARTING A TOE VALVE", the disclosure of which is incorporated here by reference.

BACKGROUND

Technical Field

Embodiments of the subject matter disclosed herein generally relate to downhole tools for well operations, and more specifically, to a toe valve used in a well for connecting the inside of a casing string to a formation.

Discussion of the Background

During well exploration, various tools are lowered into the well and placed at desired positions for plugging, perforating, or drilling the well. These tools are placed inside the well with the help of a conduit, as a wireline, electric line, continuous coiled tubing, threaded work string, etc. The most distal tool of this assembly is called the toe valve. This tool needs to be opened inside the well for various reasons, for example, for connecting the inside of the casing string to the formation.

A traditional toe valve 100 is shown in FIG. 1 as being attached to a casing string 102 and placed in a well 110 that was drilled to a desired depth H relative to the surface 112. The casing string 102, which protects the wellbore 116, has been installed and cemented in place together with the toe valve 100. To connect the wellbore 116 to a subterranean formation 118, a sleeve 120 inside the toe valve 100 needs to be moved to open ports 122, which communicate the formation 118 with the inside of the toe valve and thus, the interior of the casing.

The typical process of connecting the casing 102 to the subterranean formation 118 may include the following steps: (1) increasing the pressure inside the casing to move sleeve 120 inside the toe valve 100, and (2) opening the toe valve 100 with the increased pressure. A controller 130, located at the surface 112, is used to control the various tools and/or the pressure inside the wellbore 116.

The structure of a traditional toe valve 200 is shown in FIG. 2, and includes an inner mandrel 202 that is enclosed by an outer housing 204. The inner mandrel 202 or the outer housing 204 is attached to the casing string as shown in FIG. 1. After the toe valve 200 is cemented in place in the well, the casing's inner fluid 205 is pressurized until a burst disc 206 located in the mandrel 202 is ruptured. The fluid 205 enters inside chamber 208 and moves the piston 210. End caps 212 and 214 are threaded into the mandrel 202 and the housing 204 so that a pressure inside the chamber 208 is maintained. Plural O-rings 216 or similar seals are used to maintain the pressure inside the chamber 208.

Moving piston 210 compresses a second fluid 218 that is located in a second chamber 208'. The second fluid 218 moves through a constrictor region 220, which slows its flow, and arrives in a second chamber 208", which is filled with air. After enough of the second fluid 218 has passed through the constrictor region 220 into the third chamber 208", ports 222 formed in the outer housing 204 are opened, i.e., they directly communicate with the interior of the mandrel 202. The second fluid 218 and the constrictor region 220 are used in this toe valve as a delay mechanism for opening the toe valve. The time delay introduced by the delay mechanism is necessary for various testing of the casing string, e.g., there are government regulations that require a pressure test of the entire casing string for ensuring that the casing string is sealed and this test needs to be performed before the ports 222 are opened.

With the above design, once the opening of the ports has been initiated, the opening of the ports cannot be stopped. In other words, the opening of the ports is an irreversible process in this configuration. This is not desired for various operations for the following reasons. If a pressure test needs to be performed for the casing string, the pressure inside the casing needs to be increased to a certain value to fulfill the requirements of the test. However, if the pressure is higher than the pressure which the burst disc can withstand, then the piston 210 is activated and the ports 222 are opened. However, the ports are opened while the pressure test is performed, which means that the fluid 205 is pumped outside the casing and thus, the inner pressure decreases. This is not desired for such a test.

Thus, there is a need for a toe valve and method that can delay the opening of the valves so that a pressure test can be performed. Also, there is a need of a toe valve for which the opening of the ports is reversible, i.e., the ports may be closed if desired.

SUMMARY

According to an embodiment, there is a downhole tool for connecting an interior of a casing to a formation. The downhole tool includes an inner housing extending along a longitudinal axis X; an outer housing that encloses the inner housing and forms first and second chambers; a piston that separates the first and second chambers; a port that fluidly communicates an outside and inside of the downhole tool; and a stopping mechanism that prevents the piston from opening the port. The piston interrupts the fluid communication between the outside and inside the downhole tool.

According to another embodiment, there is a method for connecting an interior of a casing to a formation through a port opened in a downhole tool. The method includes lowering the downhole tool into a well, increasing a pressure of a fluid inside an inner housing, which extends along a longitudinal axis X inside the downhole tool, until a burst disc is broken and the fluid inside the inner housing flows into a first chamber formed between the inner housing and an outer housing, wherein the outer housing encloses the inner housing and forms the first chamber and a second chamber, further increasing the pressure of the fluid to test the casing, blocking a movement of a piston, which separates the first and second chambers, toward the second chamber, with a stopping mechanism so that a port is not opened, wherein the piston interrupts a fluid communication between the outside and inside of the downhole tool through the port, and increasing the pressure of the fluid over a threshold pressure, which results in the stopping mechanism allowing the first piston to open the port to achieve fluid communication between the inside and outside of the downhole tool.

According to still another embodiment, there is a downhole tool for connecting an interior of a casing to a formation. The downhole tool includes an inner housing extending along a longitudinal axis X, an outer housing that encloses the inner housing and forms first to fourth chambers, a piston that separates the first and second chambers, and a stopping mechanism, located between the third and fourth chambers and blocking a fluid from flowing from the third chamber to the fourth chamber. There is no port between an interior and an exterior of the downhole tool, either in the inner housing or in the outer housing.

According to yet another embodiment, there is a method for connecting an interior of a casing to a formation with a downhole tool. The method includes lowering the downhole tool into a well, increasing a pressure in a fluid hold inside an inner housing to break a burst disc, the inner housing extending along a longitudinal axis X of the downhole tool, wherein the inner housing and an outer housing, which encloses the inner housing, form first to fourth chambers, further increasing the pressure of the fluid to test the casing, increasing the pressure of the fluid until a piston that separates the first and second chambers breaks a stopping mechanism, wherein the stopping mechanism is located between the third and fourth chambers and the stopping mechanism blocks another fluid from flowing from the third chamber to the fourth chamber. There is no port between an interior and an exterior of the downhole tool, either in the inner housing or in the outer housing.

According to another embodiment, there is a downhole tool for connecting an interior of a casing to a formation. The downhole tool includes an inner housing extending along a longitudinal axis X, an outer housing that encloses the inner housing and forms first to fourth chambers, a first piston that separates the first and second chambers, a second piston that separates the third and fourth chambers, a port that is configured to fluidly communicate an outside and inside of the downhole tool, and a stopping mechanism that prevents the second piston from opening the port. The second piston is positioned to separate the port into an outer portion and an inner portion to interrupt a fluid communication between the outside and inside of the downhole tool.

According to yet another embodiment, there is a downhole tool for connecting an interior of a casing to a formation. The downhole tool includes an inner housing extending along a longitudinal axis X, an outer housing that encloses the inner housing and forms first and second chambers, a piston that separates the first and second chambers, a port that fluidly communicates an outside and inside of the downhole tool, and a stopping mechanism that prevents the piston from opening the port. An inner part of the port is formed in the piston and an outer part of the port is formed in the outer housing and the piston is positioned to misalign the inner part and the outer part so that there is no fluid communication between an inside and outside of the downhole tool.

According to another embodiment, there is a method for connecting an interior of a casing to a formation with a downhole tool that is placed in a well. The method includes increasing a pressure of a fluid to break a burst disc formed into a piston of the tow valve, the piston being housed by an inner housing of the tow valve and an outer housing, wherein the inner housing forms with the outer housing, which encloses the inner housing, first and second chambers, moving the piston, which separates the first and second chambers, toward the second chamber, and blocking a movement of the piston with a stopping mechanism to prevent the piston from opening a port. An inner part of the port is formed in the piston and an outer part of the port is formed in the outer housing and the piston is positioned to misalign the inner part and the outer part so that there is no fluid communication between an inside and outside of the downhole tool.

BRIEF DESCRIPTION OF THE DRAWINGS

The accompanying drawings, which are incorporated in and constitute a part of the specification, illustrate one or more embodiments and, together with the description, explain these embodiments. In the drawings.

DETAILED DESCRIPTION

The following description of the embodiments refers to the accompanying drawings. The same reference numbers in different drawings identify the same or similar elements. The following detailed description does not limit the invention. Instead, the scope of the invention is defined by the appended claims. The following embodiments are discussed, for simplicity, with regard to a toe valve. However, the embodiments discussed herein are also applicable to any downhole tool in which a high-pressure is used to open a port and then the opening process of the port needs to be stopped.

Reference throughout the specification to "one embodiment" or "an embodiment" means that a particular feature, structure or characteristic described in connection with an embodiment is included in at least one embodiment of the subject matter disclosed. Thus, the appearance of the phrases "in one embodiment" or "in an embodiment" in various places throughout the specification is not necessarily referring to the same embodiment. Further, the particular features, structures or characteristics may be combined in any suitable manner in one or more embodiments.

According to an embodiment, a toe valve includes a stopping mechanism that is configured to stop the moving of a piston/sleeve, and thus, the opening of the ports. In one application, the stopping mechanism is configured to push back the piston, when a pressure inside the casing is reduced, so that the opening operation of the ports can be reversed. In one embodiment, the stopping mechanism includes plural stages for opening the ports.

Figure 3A:
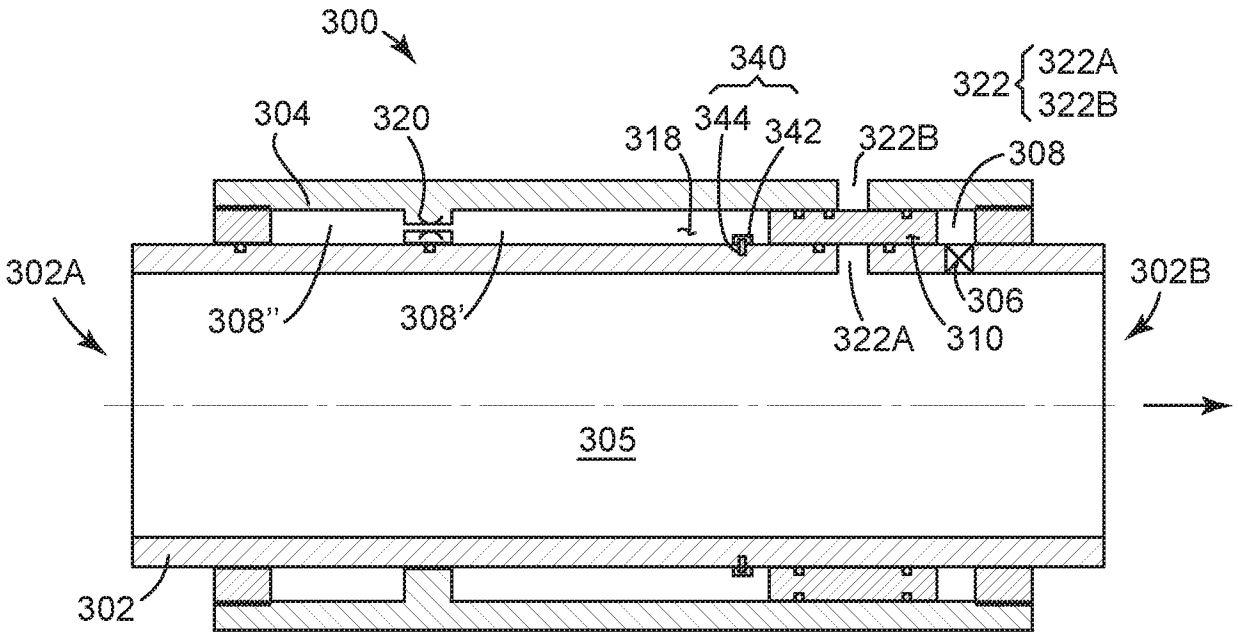
FIGS. 3A and 3B illustrate a toe valve having a delay mechanism.

FIG. 3A shows an embodiment in which a toe valve 300 (in fact, other downhole tools may have this configuration) has a stopping mechanism 340 that includes a stop part 342 and at least one shearable part (e.g., a shear pin) 344. The shear pin 344 is attached to an inner housing (e.g., a mandrel 302 and the stop part 342 is attached to the shear pin 344. Note that inner housing 302 has two ends, a proximal end 302A and a distal end 302B. The inner housing 302 extends along a longitudinal axis X, which is horizontal for the horizontal part of the well. In this application, the proximal end is defined as being the end of the inner housing that is closest to the head of the well, when the inner housing is located inside the well, and the distal end is the end farthest from the head of the well (the end closest to the toe of the well). The stop part 342, which may be a full ring, or part of a ring, is located in the second chamber 308', between the piston 310 (this element can also be seen as being a sleeve) and the constrictor region 320. When the burst disc 306 is broken by the increased pressure of the first fluid 305, the piston 310 moves (due to the first fluid pressure) toward the stop part 342 (or toward the proximal end 302A of the inner housing) until it touches the stop part. The stop part 342 and the shear pin 344 are configured to stop the movement of the piston 310 until a pressure equal to or larger than a threshold pressure (that depends on the strength of the shear pin 344) is applied.

For example, consider that the normal working pressure inside a bore of the inner housing 302 is P1, the burst disc 306 breaks at a pressure P2, which is higher than P1, and the pressure of the pressure test at which the toe valve should withstand is P3, larger than P2. For this situation, the shear pin 344 is manufactured to have a thickness and/or be made of a material that can withstand the pressure P3 applied by the piston 310. However, the shear pin 344 is made to break at a pressure P4 (the threshold pressure), that is larger than P3. This means that after the pressure test at pressure P3 has concluded, it is the operator's choice whether to relieve the pressure inside the inner housing, and thus prevent the opening of the ports 322, or to apply a pressure equal to or larger then P4, to break the shear pin 344 and force the piston 310 to remove the second fluid 318 from the second chamber 308' and fully open the ports 322. Note that a port 322 is understood to have a first part 322A formed in the inner housing and a second part 322B formed in the outer housing. The piston 310 is designed to interrupt the fluid communication between the first and second parts 322A and 322B until the piston moves towards the proximal end of the inner housing. Further note that if the shear pin 344 is broken, then the piston 310 can move toward the constrictor region 320 as the stop part 342 is free to move. If the stop part 342 is a full ring, then plural shear pins 344 may be used to keep the stop part attached to the inner housing 300. While FIG. 3A shows the shear pins 344 attached to the body of the inner housing 302, in one embodiment it is possible to attach the shear pins 344 to the outer housing 304. One skill in the art would understand that the stop part 342 may be attached to the inner housing or outer housing with other means, e.g., welded or screwed, but these other means are also designed to break from the housing when the pressure in the bore is higher than pressure P4. When the piston 310 has moved toward the proximal end 302A in the second chamber 308', the fluid communication between the first part 322A and the second part 322B is achieved and the port 322 is considered to be open. Note that in one embodiment, the constrictor region 320 is also part of the stopping mechanism 340, so that the stopping mechanism is multi-staged, i.e., provides time delays with different values for each stage. In this particular embodiment, there are two stages of delay, one provided by shear pin 344 and the other one provided by the constrictor region 320.

Figure 3B:
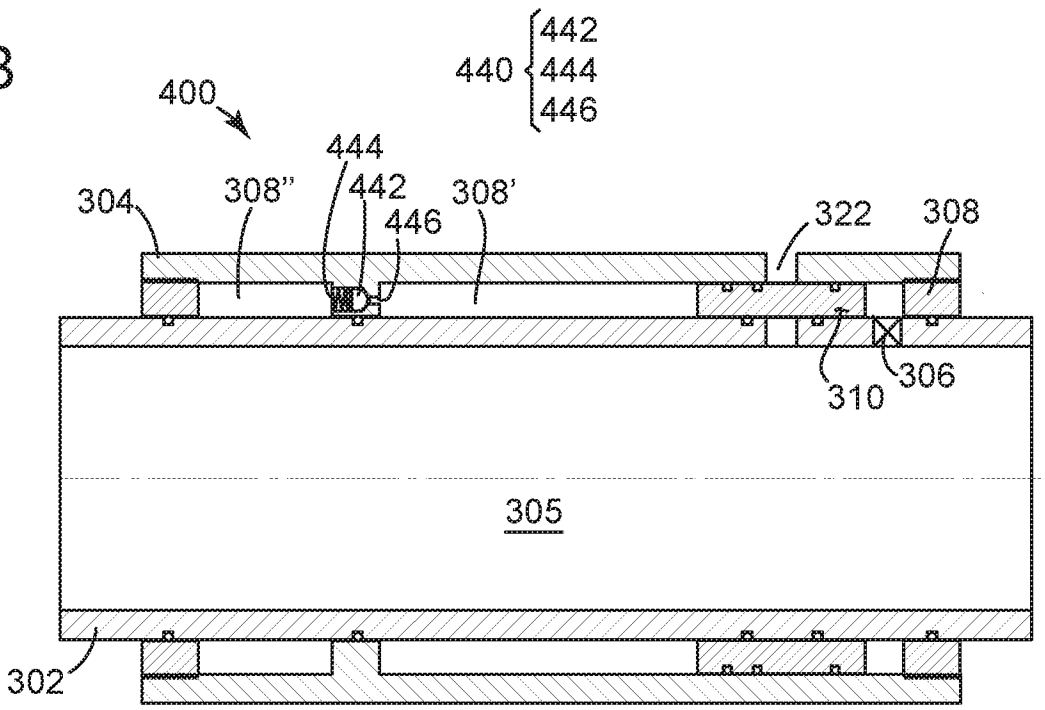

Another embodiment is illustrated in FIG. 3B, in which the stopping mechanism 440 includes a check valve with or without the restrictor region 320. FIG. 3B shows a toe valve 400 not including the restrictor region. Check valve 440 may include, for example, a ball 442 and a spring 444. The ball 442 blocks a channel 446 formed between the second chamber 308' and the third chamber 308" and the spring 444 biases the ball 442 to keep the channel 446 shut. The spring constant of the spring 444 is chosen so that the check valve opens only when the pressure of the second fluid in the second chamber 308' is equal to or larger than P4. One or more additional stages, as discussed later, may be added to this toe valve. In this regard, one skilled in the art would know to combine the various stages discussed herein.

Figure 4:
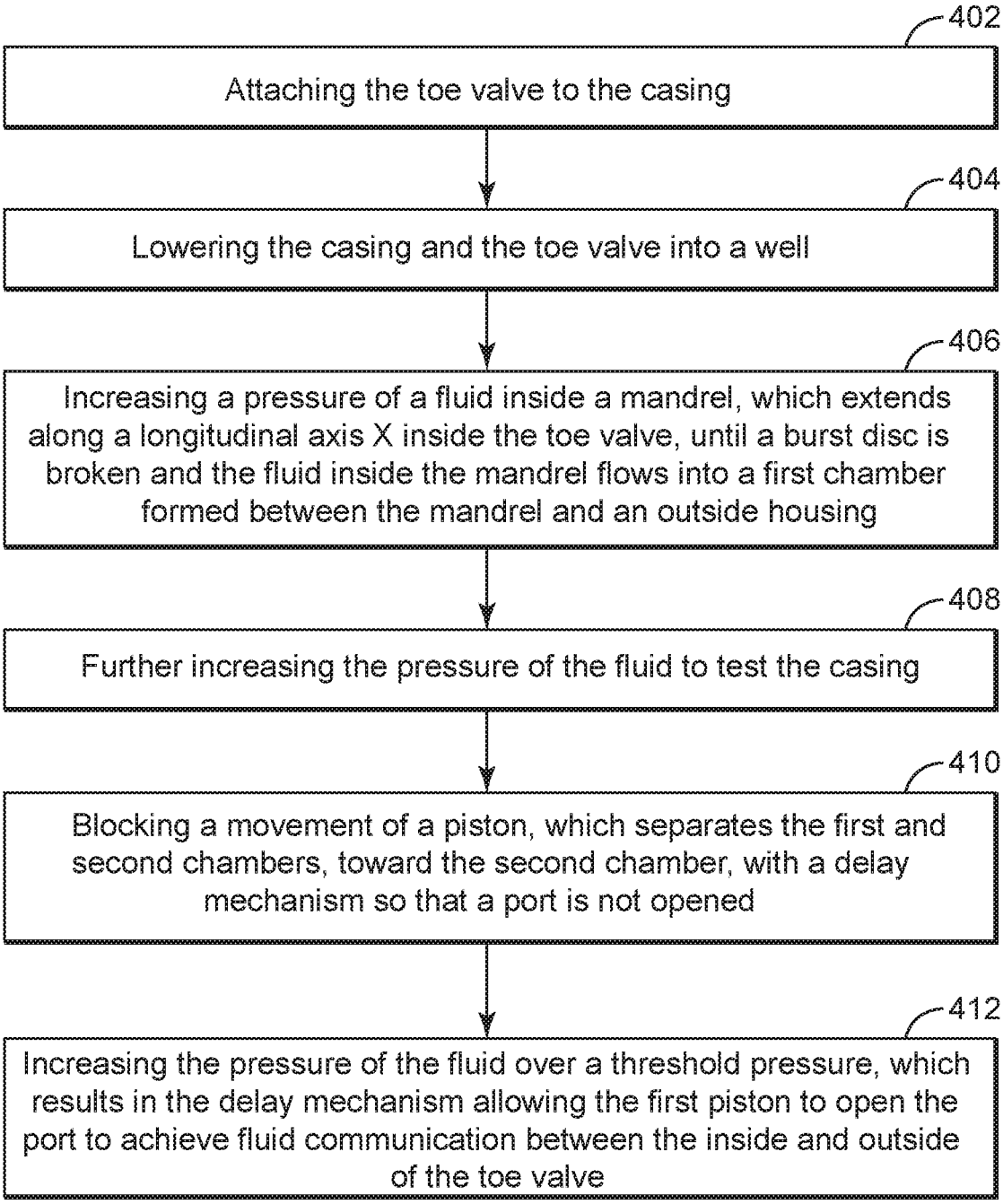
FIG. 4 is a flowchart of a method for using a tow valve with a delay mechanism.

FIG. 4 illustrates a method for connecting an interior of a casing to a formation through a port in a toe valve as discussed above. The method includes a step 402 of attaching the toe valve 300 or 400 to a casing 102, a step 404 of lowering the casing 102 and the toe valve 300 or 400 into a well 110 and cementing the casing and the toe valve in place, a step 406 of increasing a pressure of a fluid 305 inside an inner housing 302 of the toe valve, which extends along a longitudinal axis X, inside the toe valve 300, until a burst disc 306 is broken and the fluid 305 inside a bore of the inner housing flows into a first chamber 308 formed between the inner housing and an outer housing 304. The outer housing encloses the inner housing 302 and forms the first chamber 308 and a second chamber 308'. The method further includes a step 408 of further increasing the pressure of the fluid 305 to test the casing 110, a step 410 of blocking a movement of a piston 310, which separates the first and second chambers 308, 308', toward the second chamber, with a stopping mechanism 340/440 so that a port 322 is not opened. Note that the piston 310 interrupts a fluid communication between the outside and inside of the toe valve through the port 322. The method further includes a step 412 of increasing the pressure of the fluid 305 over a threshold pressure, which results in the stopping mechanism changing its status and allowing the first piston/sleeve to move to open the port 322, to achieve fluid communication between the inside and outside of the toe valve.

Figure 5:
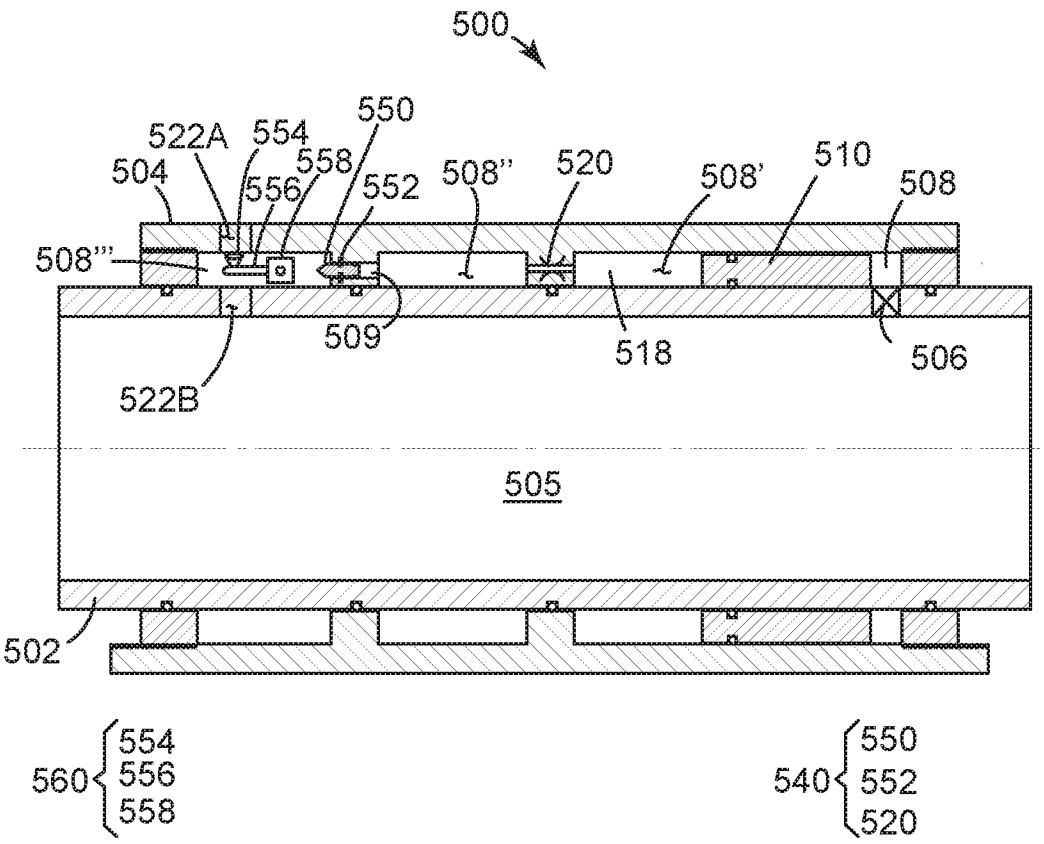
FIG. 5 illustrates a toe valve with no ports.

FIG. 5 illustrates another embodiment of a toe valve in which there are no ports formed in the inner housing 502 or the outer casing 504. Further, according to this embodiment, there is a fourth chamber 508''' defined by the inner housing and the outer casing that communicates, via a passage 509, with the third chamber 508". A stopping mechanism 540 includes plural components 520, 550, 552, which are now discussed. Restrictor region 520 has been previously discussed with regard to toe valve 300 or 400. Thus, its description is omitted herein. As also previously discussed, the restriction region 520 may be considered to be a stage in a multi-stage stopping mechanism 540, the other stages being achieved by elements 550 and 552. In the passage 509, a firing pin 550 is located to block the flow of the second fluid 518 from the third chamber 508" to the fourth chamber 508'''. Note that the second fluid 518 can flow, through the restrictor region 520, between the second chamber 508' and the third chamber 508", as in the previous embodiments. Firing pin 550 is maintained in the passage 509 with one or more shearable elements (e.g., shear pins) 552. The one or more shear pins 552 are attached to the outer housing 504 or the inner housing 502 or both.

Inside the fourth chamber 508''', there is an explosive mechanism 560 that includes an explosive charge 554, a detonator 556, and a detonator cord 558. If the firing pin 550 is projected against the detonator cord 558, the detonator cord ignites. The ignition of the detonator cord ignites the detonator 556, which in turn sets off the explosive charge 554. The explosion of the explosive charge 554 forms a port 522A in the outer casing 504 and a port 522B in the inner housing 502, which makes the bore of the inner housing to fluidly communicate with the outside of the toe valve. The ports are formed by melting and removing part of the material of the inner housing and the outer casing due to the high temperature generated by the explosive charge.

Figure 6:
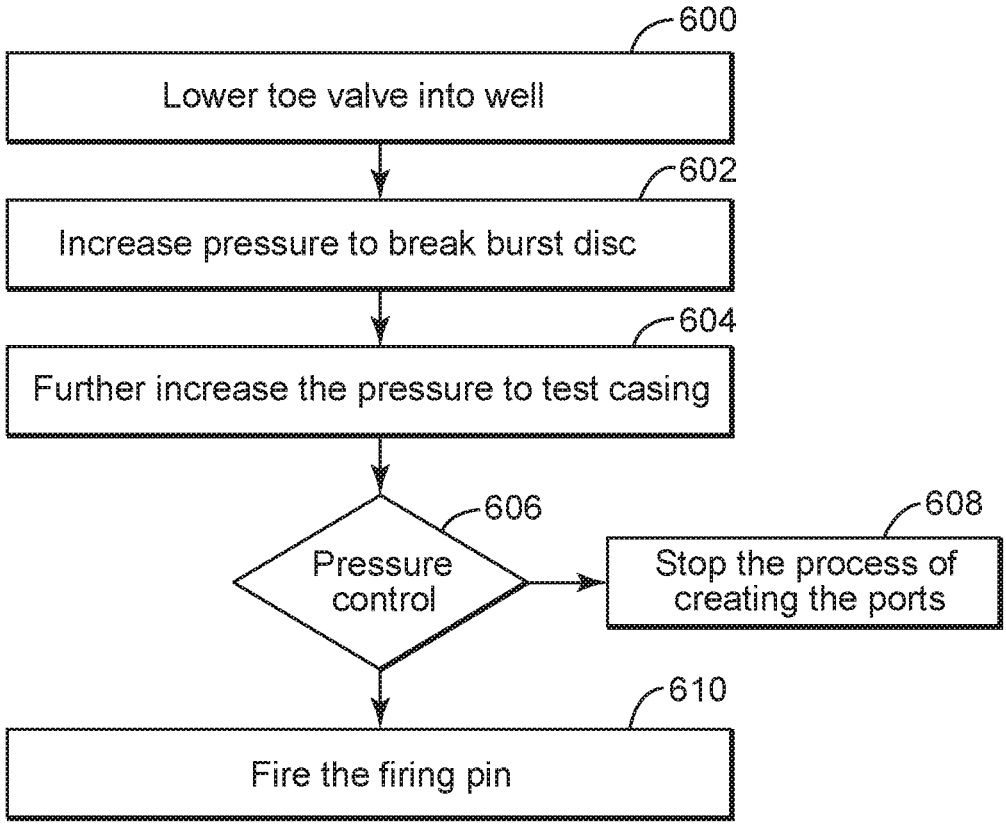
FIG. 6 is a flowchart of a method for using a tow valve with no ports.

A method for making the ports 522A and 522B in the toe valve is discussed with regard to FIG. 6. In step 600, the toe valve is lowered together with the casing into the well and both elements are cemented. The toe valve has no ports that fluidly communicate an interior (bore) of the toe valve with an exterior of the toe valve. In step 602, an internal pressure in the inner housing of the toe valve is increased until a burst disc is ruptured. At this time, the first fluid 505 inside the casing string enters inside the first chamber 508 and pushes the piston 510 toward the second chamber 508'. During this process, the second fluid 518 from the second chamber 508' is pushed into a third chamber 508". The second fluid 518 is delayed in arriving in the third chamber 508" by the restrictor region 520 (the first stage of the delay mechanism). As the pressure of the second fluid 518 in the third chamber 508" is increasing, the firing pin 550 is preventing the second fluid from entering the fourth chamber 508'". The shear pin 552 is configured to hold this pressure until a certain threshold pressure is reached.

In step 604, the pressure inside the inner housing increases to test, for example, the integrity of the casing string. The pressure in this step is below the threshold pressure noted above, and thus, the shear pin is not broken. In step 606 a decision is made by the operator of the well whether to stop the process or not. If the operator decides to stop the process, the pressure inside the inner housing is reduced in step 608 and the shear pin 552 continues to hold the firing pin 550, so that the charges are not detonated and no ports are made in the toe valve. This means, that there is no fluid communication between the outside and inside of the toe valve. However, the operator may decide in step 606 to create the ports. In this case, the pressure inside the inner housing is increased in step 620 until the pressure is larger than the threshold pressure. At that point, the pressure exerted by the second fluid 518 on the firing pin 550 breaks the shear pin 552 and the firing pin 550 ignites the detonator cord 558 by striking it very rapidly. The detonator cord 558 ignites the detonator 556, which in turn makes the charge 554 to explode, and thus, the ports 522A and 522B are formed. Fluid communication is established between the outside and inside of the toe valve.

Figure 7:
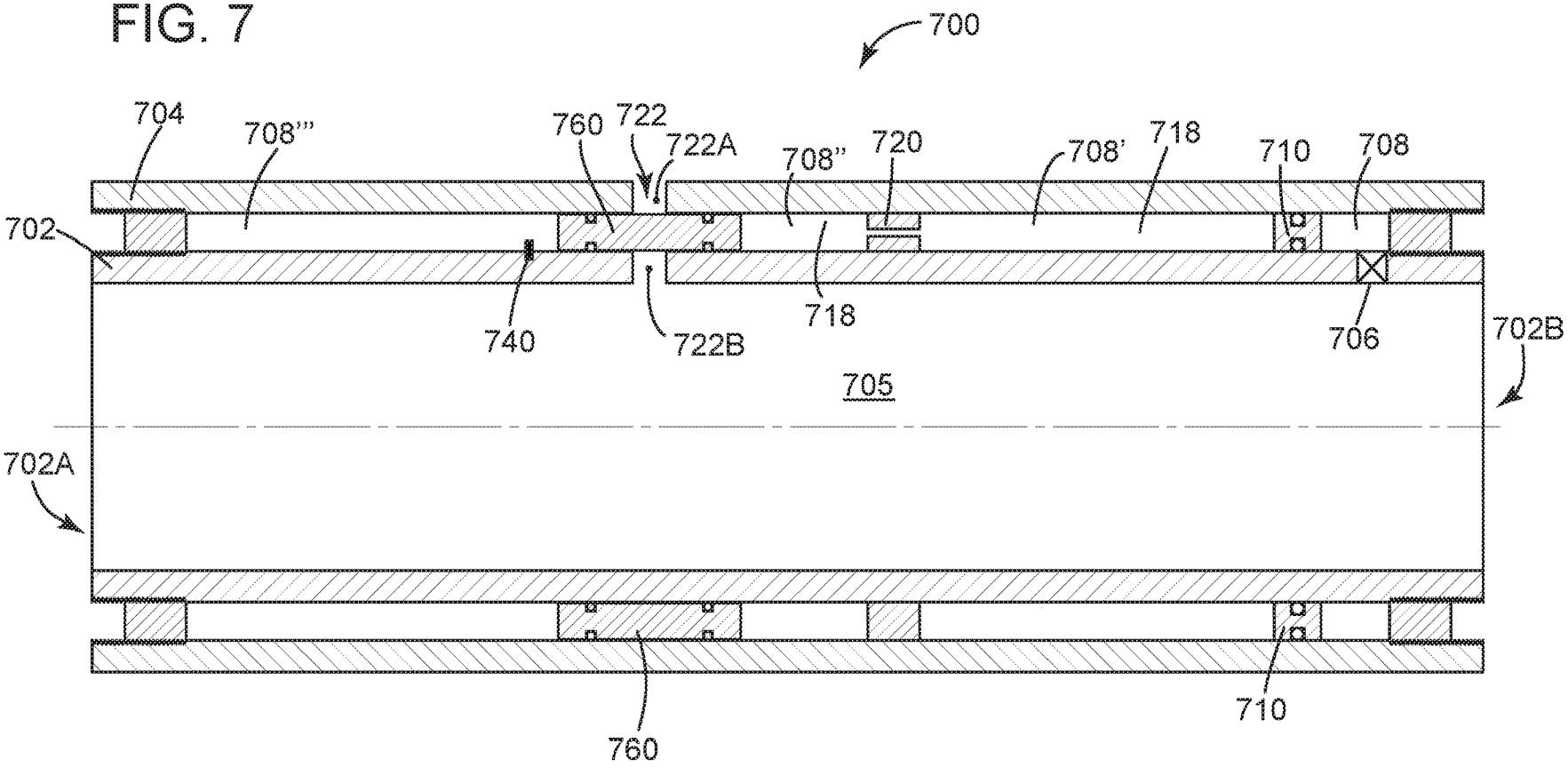
FIGS. 7 to 9 illustrate a toe valve having at least two pistons.

Another toe valve is illustrated in FIG. 7 and this valve is configured to control when the ports are opened. The toe valve 700 of FIG. 7 has a second piston 760, in addition to the first piston 710. The second piston 760 can move when the second fluid 718 is building enough pressure. First and second chambers 708 and 708' are similar to the previous embodiments, with the first chamber 708 being fluidly insulated from an interior of the inner housing 702 by a burst disc 706. In this embodiment, the ports 722 are formed between the third and fourth chambers 708" and 708'" so that the second piston 760 blocks them and not the first piston 710 as in the previous embodiments. Port 722 has an outer portion 722A formed in the outer housing and an inner portion 722B formed in the inner housing and the second piston 760 is positioned to interrupt a fluid communication between the inner and outer portions.

Figure 1:
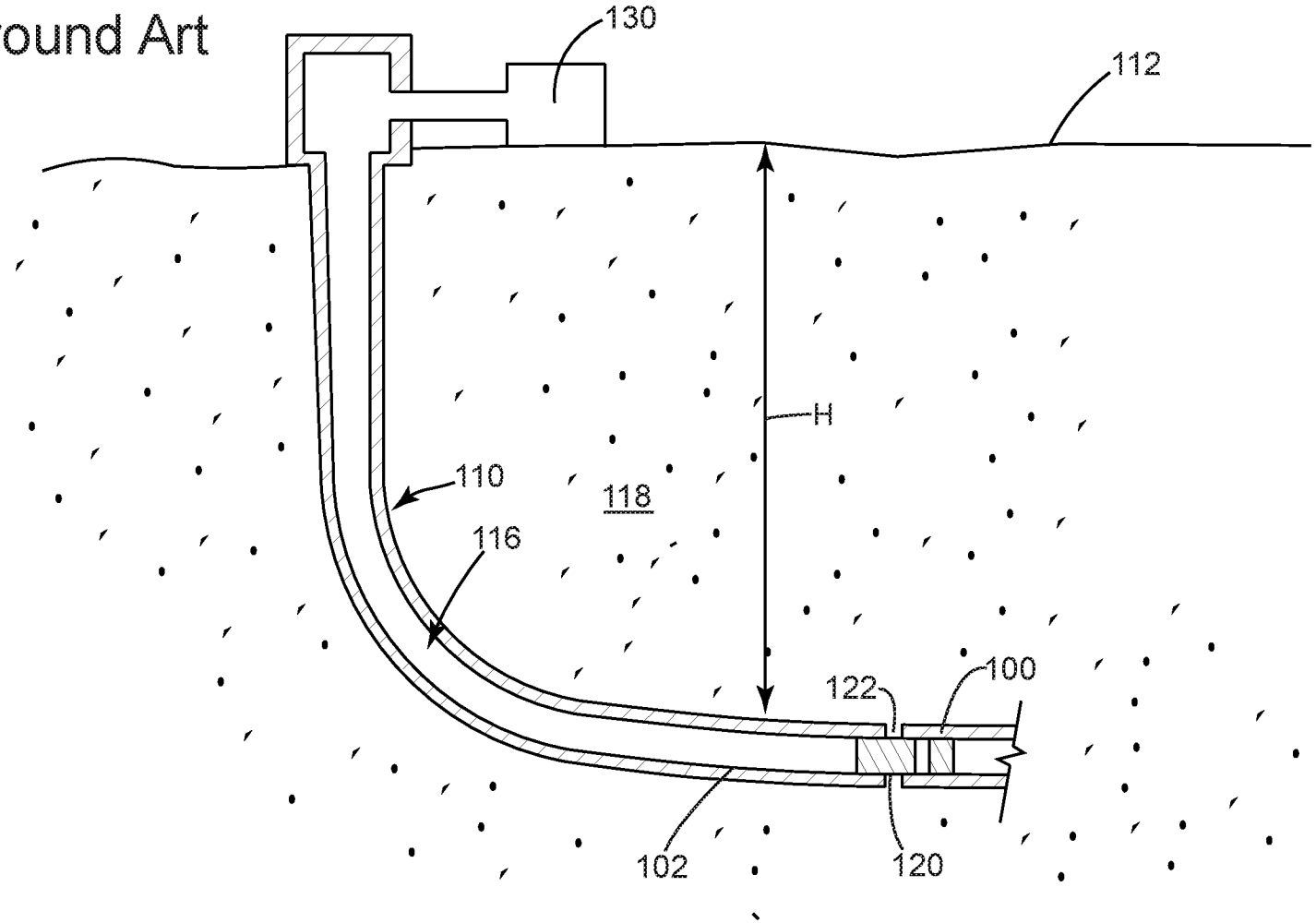
FIG. 1 Background Art
FIG. 1 illustrates a toe valve that is cemented into a well.
Figure 2:
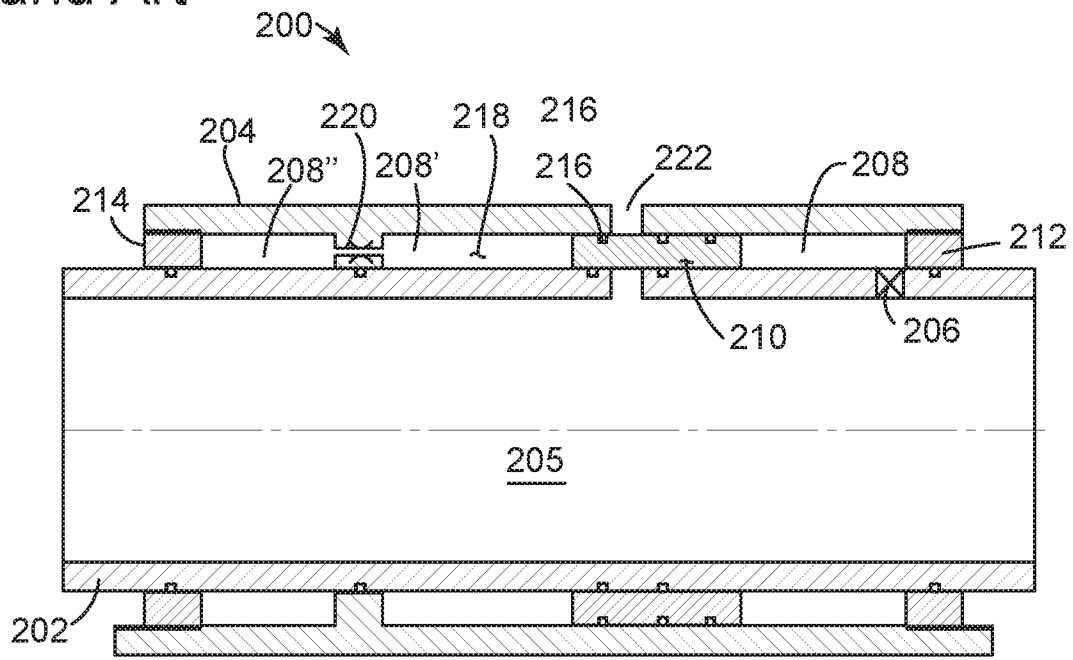
FIG. 2 Background Art
FIG. 2 illustrates a traditional toe valve.

The restrictor region 720 (first stage) is located between the inner housing 702 and the outer housing 704, and between the second chamber 708' and the third chamber 708". When in use, the first fluid 705 is pressurized by a pump from the surface so that the burst disc 706 is broken. The first fluid 705 enters inside the first chamber 708 and pushes the first piston 710 toward the restrictor region 720. A second fluid 718 present in the second chamber 708', is forced through the restrictor region 720 into the third chamber 708", which is filled with air. The pressure inside the third chamber 708" builds up slowly, but when enough pressure is built, the second piston 760 moves quickly toward a proximal end 702A of the inner housing 702 (second stage). Because the second piston 760 moves quickly to open the ports 722, this process is called "no jetting." The "jetting" process can be seen in the embodiment of FIG. 2, where the piston 216 moves slower toward the proximal end of the inner housing when the burst disc is broken.

Returning to the embodiment of FIG. 7, when the second piston 760 moves toward the proximal end 702A of the inner housing, past the ports 722, the ports are fully open. Optionally, the toe valve 700 may include one or more shear pins 740 (third stage) placed inside the fourth chamber 708'" for stopping the opening process of the ports. In other words, if the pressure inside the inner housing is below the breaking point of the shear pin 740, the opening process of the ports is stopped because the second piston 760 cannot pass the shear pin 740 until a larger pressure is applied to the first fluid 705 to break the shear pin and fully open the ports 722 by moving the second piston past the broken shear pin 740. The toe valve shown in FIG. 7 is called a two stage unit with no jetting.

Figure 8:
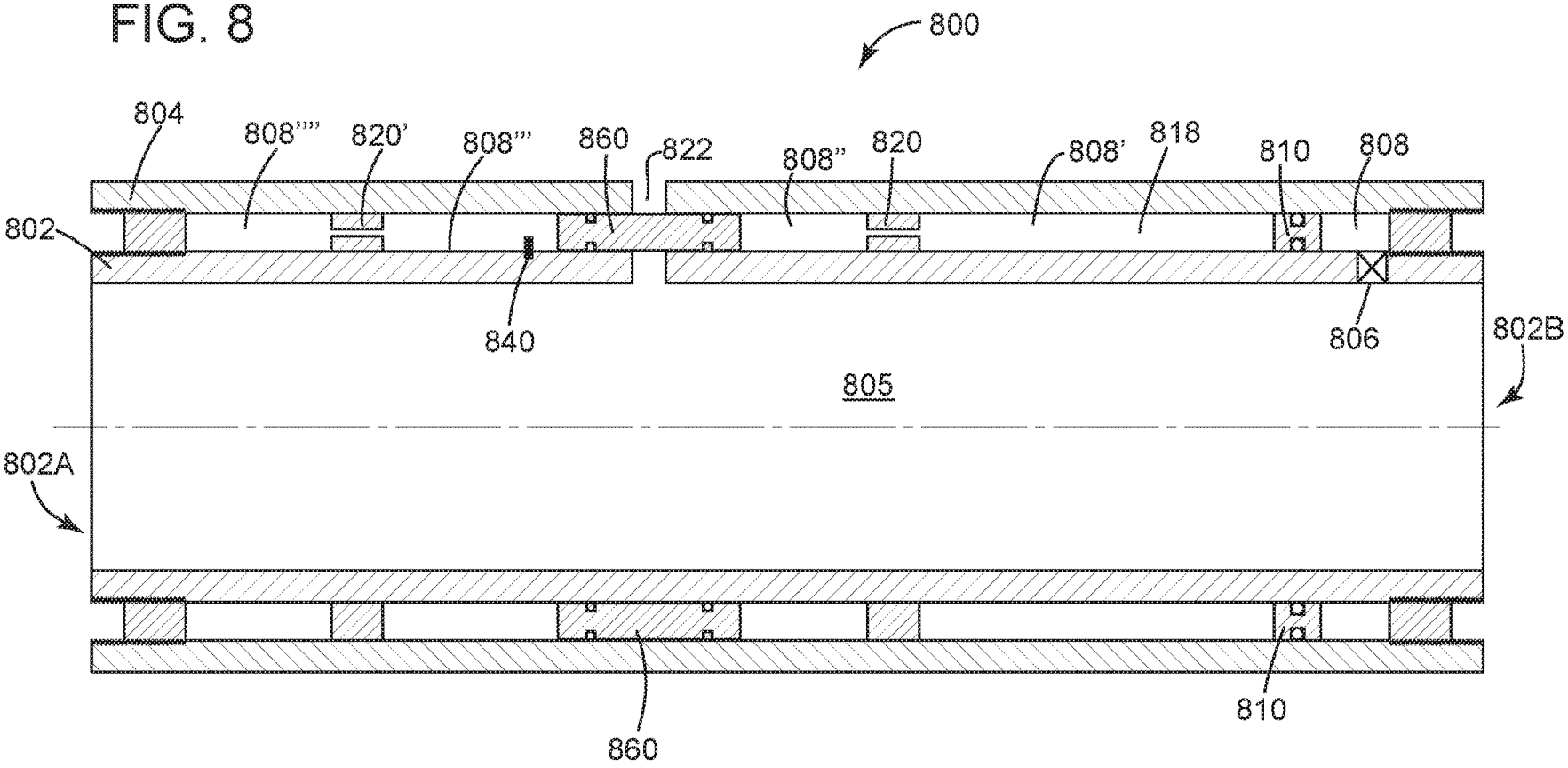

A two-stage toe valve with jetting is illustrated in FIG. 8. In this figure, the stages are considered to be determined by the number of constrictor regions 820 and 820'. The toe valve 800 is different from that of the embodiment of FIG. 7 because of the presence of a fifth chamber 808"" (in addition of first to four chambers 808, 808', 808" and 808'") and a second constrictor region 820' (thus, an additional stage is added). The purpose of the second constrictor region 820', which is located between the fourth chamber 808'" and the fifth chamber 808"", is to slow down the movement of the second piston 860 toward the proximal end 802A of the inner housing 802. In this way, the ports 822 are slowly opened, i.e., with jetting.

For this embodiment, the burst disc 806 breaks when a pressure of the first fluid 805 increases over a certain value. The first fluid 805 enters the first chamber 808 and pushes the first piston 810 toward the proximal end 802A of the inner housing 802. The second fluid 818 present in the second chamber 808' is compressed and slowly moves through the first constrictor region 820 into the third chamber 808", which is filled with air. If the pressure of the first fluid 805 is less than a threshold pressure, then the second piston 860 moves toward the proximal end 802A of the inner housing, but not enough to open up the ports 822, because of the presence of the shear pin 840, which blocks a further movement of the second piston. Thus, the opening process is stopped while a high pressure is present in the casing for testing or for other purposes. However, if the pressure of the first fluid 805 is increased over the threshold pressure, then the second piston 860 breaks the shear pin 840 and completely opens the ports 822. The movement of the second piston 860, after the shear pin 840 is broken, is slowed down by the second constrictor region 820', as this element allows a limited amount of air from the fourth chamber 808'" to flow into the fifth chamber 808"".

Figure 9:
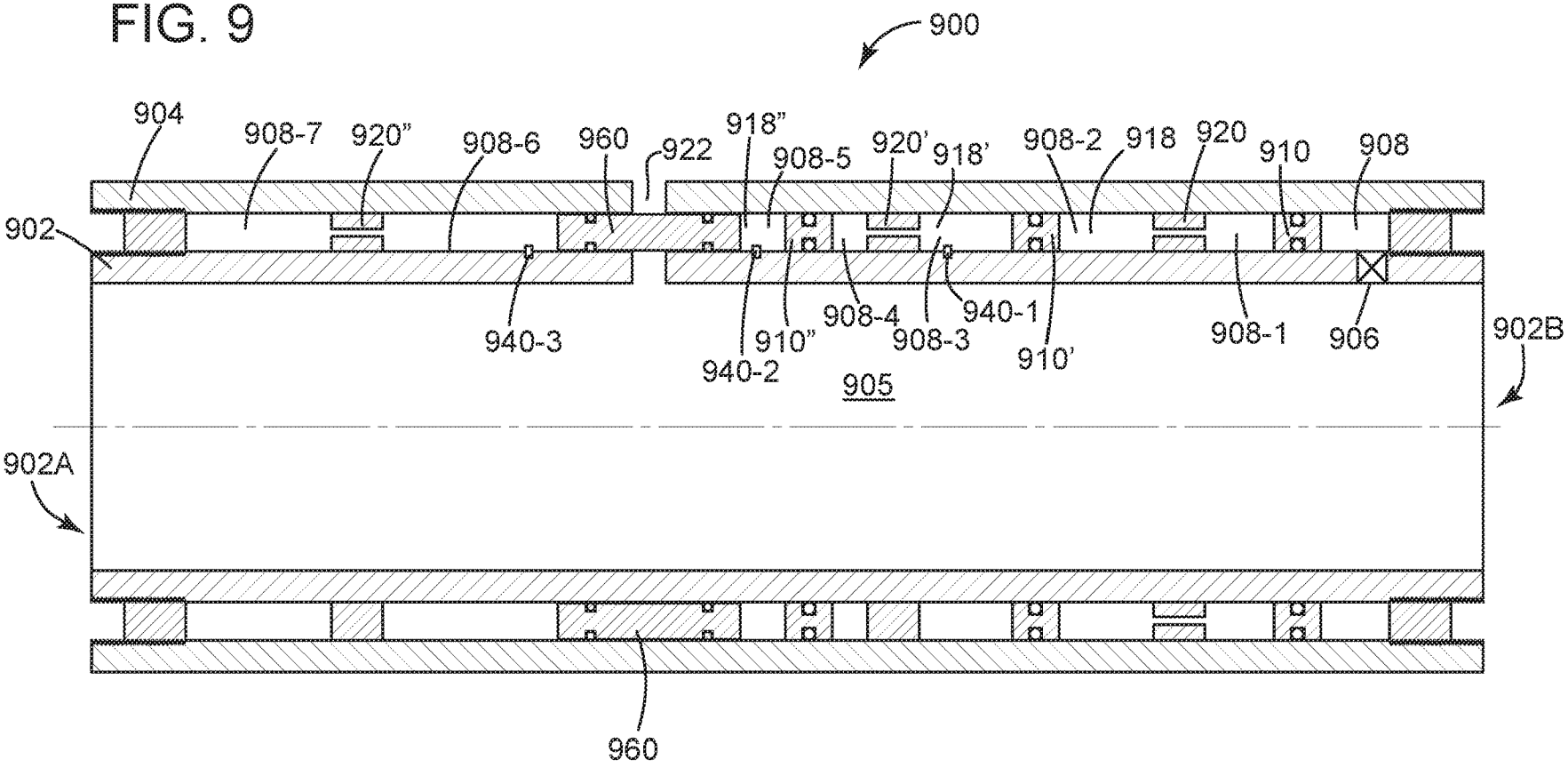

A three-stage toe valve with jetting is now discussed with regard to FIG. 9 (note the presence of three constrictor regions). The toe valve 900 in this figure has eight chambers 908 to 908-7 and four pistons (sleeves) 910 to 910" and 960. Except the first piston 910, each of the remaining pistons may have a corresponding shearable element (e.g., shear pin) 940-1 to 940-3. This means that there are three shear pressures Ps1, Ps2, and Ps3 associated with the three shear pins, and each of the pins is manufactured to break at one of these pressures. Thus, with this toe valve, a range of pressures can be applied inside the inner housing before finally opening the ports 922. In one embodiment, the three shear pins are manufactured to shear at different pressures. In another embodiment, two or more of the shear pins are manufactured to shear at similar pressures.

For example, consider that a pressure inside the inner housing 902 is above a breaking pressure of the burst disc 906. The burst disc 906 breaks and the fluid 905 enters inside the first chamber 908. The pressure of the fluid 905 makes the first piston 910 to move toward the proximal end of the inner housing 902. The second fluid 918, which is present in the second chamber 908-1, starts to slowly move through first constrictor region 920 into the third chamber 908-2, where it acts on a second piston 910'. If the pressure inside the inner housing is smaller than Ps1, the second piston 910' is stopped by the shear pin 940-1 and the process stops. However, if the pressure inside the inner housing 902 is increased over the pressure Ps1, then the first shear pin 940-1 is broken and the second piston 910' moves toward the second constrictor region 920'. A third fluid 918', which is present in the fourth chamber 908-3 is forced through the second constrictor region 920' into the fifth chamber 908-4, where the pressure pushes a third piston 910" toward the proximal end of the inner housing. The movement of the third piston 910'" is stopped by the second shear pin 940-2. However, if the pressure in the inner housing is increased to be above Ps2, this second shear pin 940-2 is broken and the third piston 910" pressurizes a fourth fluid 918'" present in the sixth chamber 908-5.

As the fourth fluid 918" present in the sixth chamber 908-5 is pressurized, the fourth piston 960 starts moving toward the proximal end of the inner housing in a process of opening the ports 922. This process is stopped by third shear pin 940-3. If the pressure inside the inner housing is increased above Ps3, then this third pin 940-3 is broken and the fourth piston 960 further moves toward the proximal end of the inner housing. The third constrictor region 920" and the eight chamber 908-7 allow only a slow movement of the air, from the seventh chamber 908-6 to the eight chamber 908-7, so that the fourth piston 960 opens the ports 922 with jetting (i.e., slow port opening). Those skilled in the art would understand that further chambers and pistons may be added for regulating the pressures available for testing or other purposes inside the inner housing, prior to fully opening the valves 922 and achieving a complete fluid communication between the inside and the outside of the toe valve.

Figure 10:
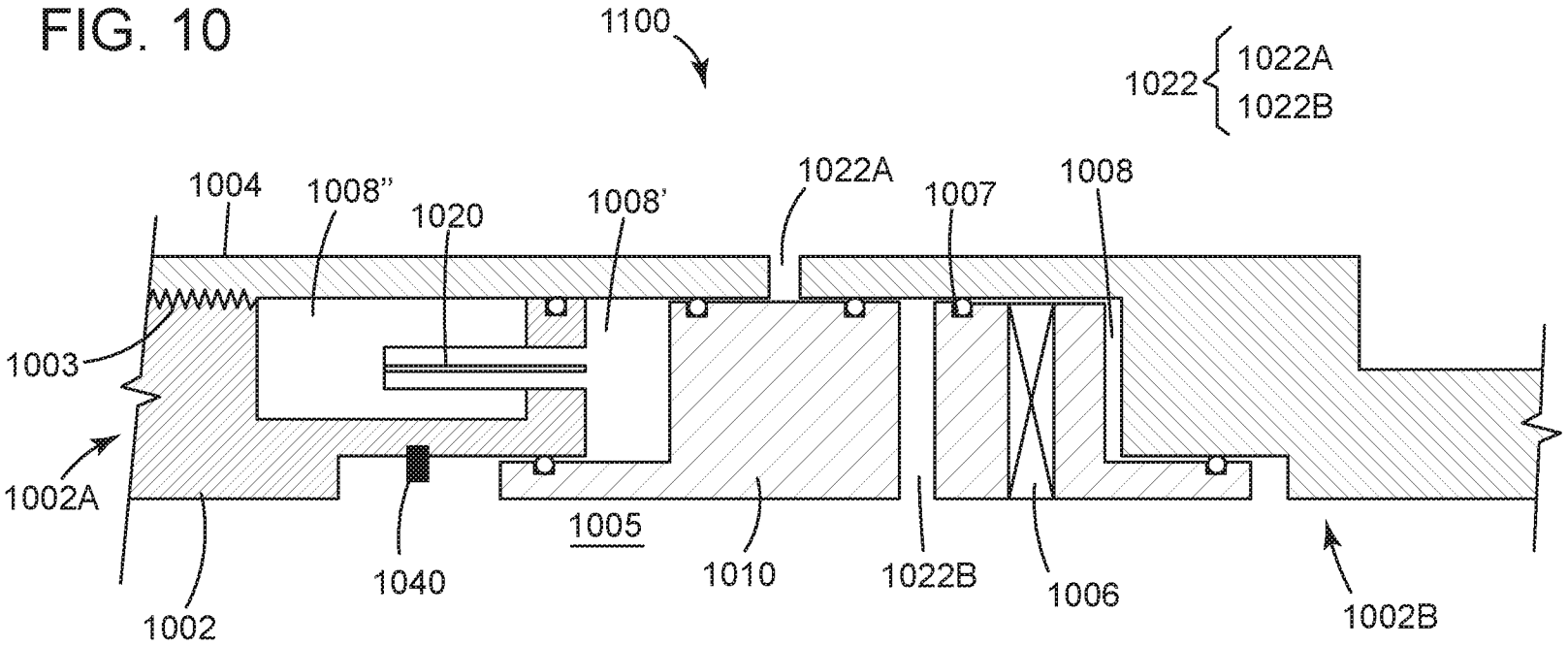
FIGS. 10 and 11 illustrate a toe valve having a part of a port formed in a piston.
Figure 11:
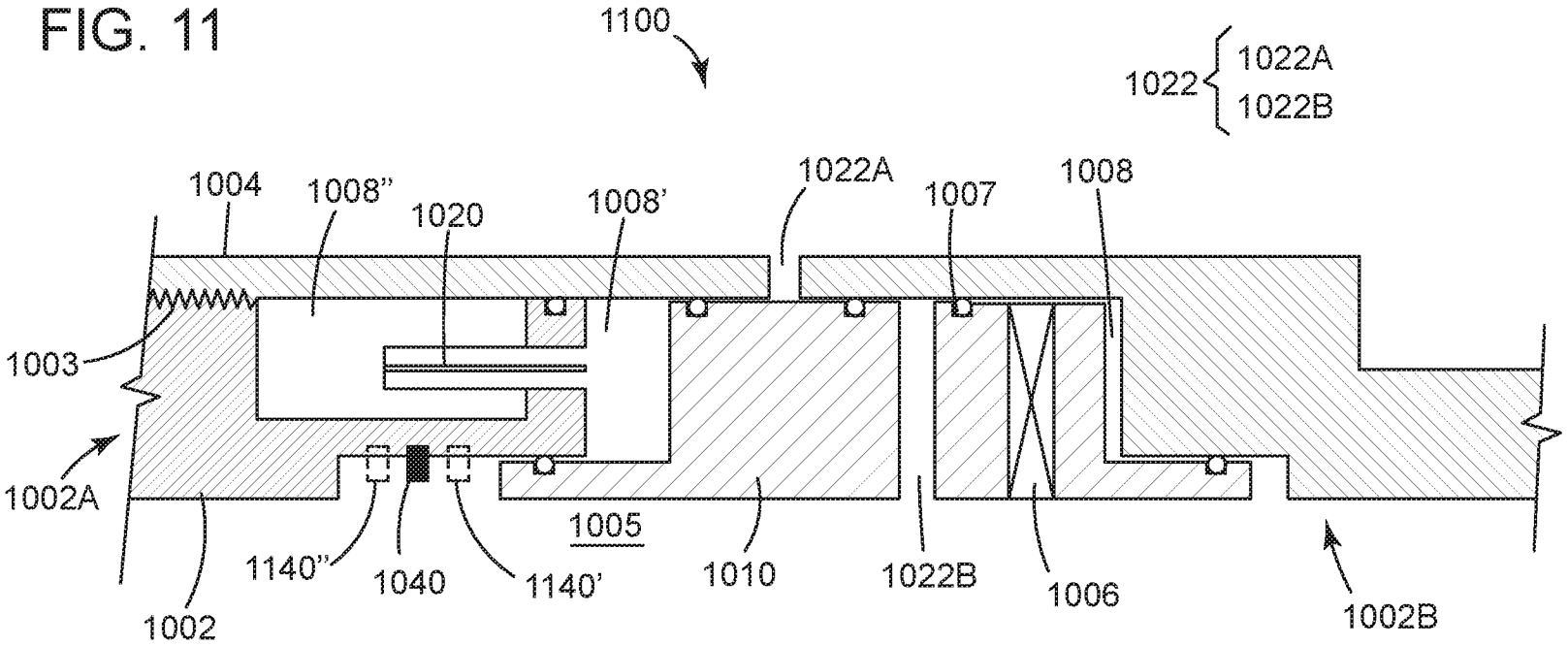

While most of the previous embodiments show a toe valve in which the ports are formed in the external housing and the inner housing, at the same longitudinal position, and the communications between the two ports in interrupted by a moving piston, the next embodiment illustrated in FIGS. 10 and 11 shows a toe valve in which the ports are made in the external housing and the piston itself. The two ports are initially misaligned so that no fluid communication is present between the inside and outside of the toe valve. When the piston is moved, then the ports are aligned and the fluid communication between the inside and outside of the toe valve is achieved.

FIG. 10 shows the upper half of a toe valve 1000 that has a piston 1010 that holds the burst disc 1006 and also a part 10226 of the port 1022. The other part 1022A of the port 1022 is formed in the wall of the outer housing 1004. The outer housing 1004 is attached to the inner housing 1002 with a thread 1003. FIG. 10 shows the piston 1010 separating the first chamber 1008 from the second chamber 1008'. Toe valve 1000 also has a constrictor region 1020 that allows the air from the second chamber 1008' to slowly move into a third chamber 1008" when a pressure in the first chamber 1008 increases. A shear pin 1040 is attached to the inner housing 1002 for blocking a movement of the piston 1010.

In use, the fluid 1005 from inside the inner housing 1002 is pressured until its pressure breaks the burst disc 1006. At this point, the fluid 1005 enters inside the first chamber 1008 and starts to move the piston 1010 toward the proximal end 1002A of the inner housing. Note that in this embodiment, the piston 1010 is not fully enclosed between the inner housing 1002 and the outer housing 1004 as in the previous embodiments. In this embodiment, the piston 1010 is actually directly facing the inner region of the inner housing, where the fluid 1005 is hold. As the pressure of the fluid 1005 increases, the piston 1010 further moves toward the proximal end of the inner housing, until reaching the shear pin 1040. At this time, if the pressure of the fluid 1005 inside the inner housing is not further increased, the piston 1010 stops, without aligning the port 1022A to the port 1022B. Thus, no fluid communication is established between the inside and outside of the toe valve and the testing of the casing can continue at this pressure.

However, if the pressure inside the inner housing is further increased, beyond the breaking pressure of the shear pin 1040, then the shear pin 1040 breaks and the piston 1010 moves all the way to align the port 1022A to the port 1022B. This movement is slowed down by the movement of the air from the second chamber 1008' through the constrictor region 1020 into the third chamber 1008".

An advantage of this configuration relative to the previously discussed configurations is the use of less O-rings 1007. Note that all the embodiments show various locations of the O-rings. Another advantage of this configuration is the reduced number of parts, only 3 main parts versus 6 for the previous toe valves. Also note that the ports 1022A and 10226 may be angled so that a perfect alignment of the ports is not critical.

FIG. 11 shows another embodiment in which the toe valve 1100 is similar to toe valve 1000, but has additional shear pins 1140' and 1140" to further stop the movement of the piston 1010. Thus, this toe valve can be used for multiple stop and start operations with the shear pins being configured to broke at the same or different pressures. The pins are spaced apart so that each is completely sheared before the next one.

Figure 12:
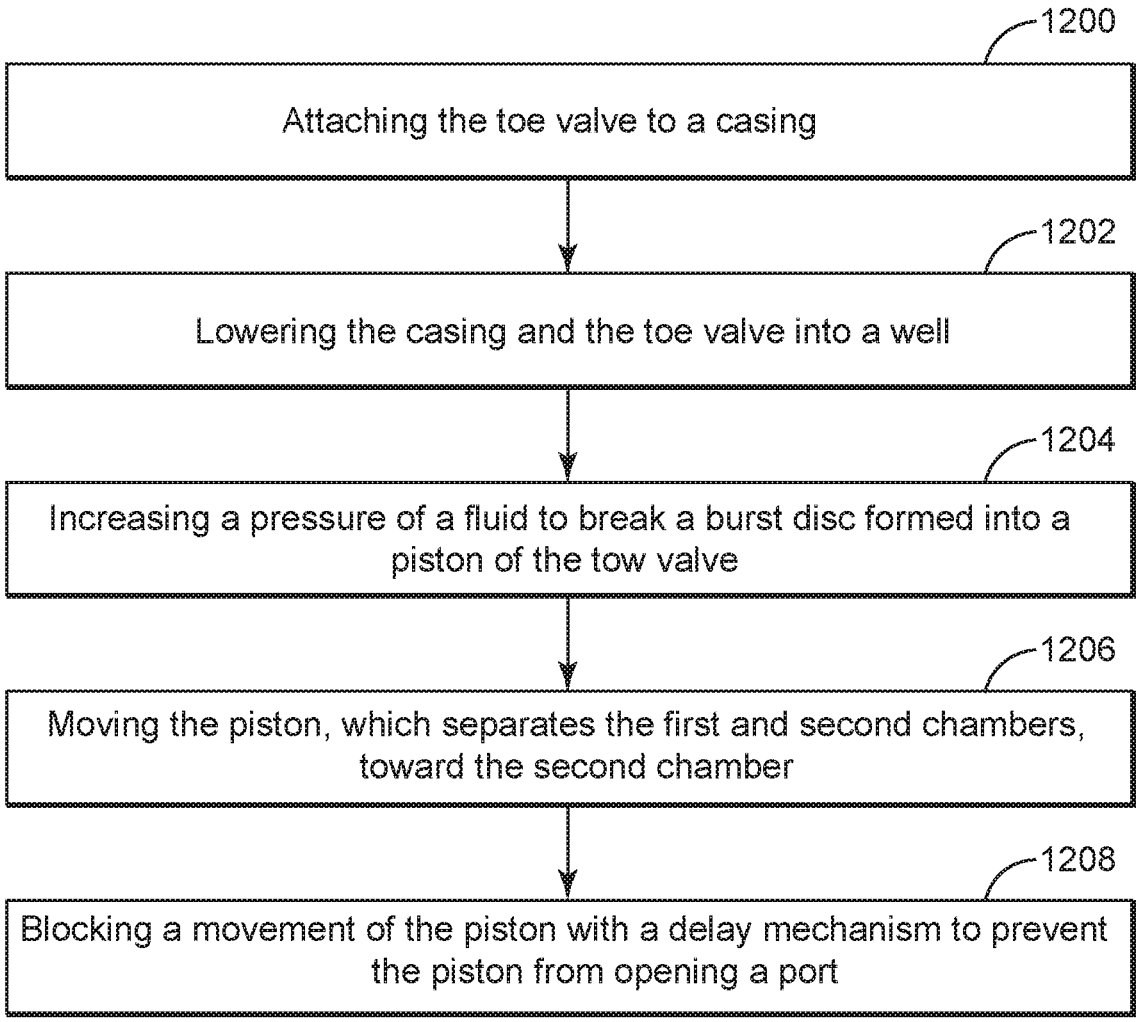
FIG. 12 is a flowchart of a method for actuating a toe valve with a part of a port formed in the piston.

FIG. 12 illustrates a flowchart of a method for connecting an interior of a casing to a formation with a toe valve 1000. The method includes a step 1200 of attaching the toe valve 1000 to a casing 102, a step 1202 of lowering the casing 102 and the toe valve 1000 into a well 110 and then cementing the toe valve in place, a step 1204 of increasing a pressure of a fluid 1005 inside a casing to break a burst disc 1006 formed into a piston 1010 of the tow valve, where the piston is housed by an inner housing 1002 and an outer housing 1004, which encloses the inner housing 1002, and the inner housing and the outer housing form first and second chambers 1008, 1008'. The method further includes a step 1206 of moving the piston 1010, which separates the first and second chambers 1008, 1008', toward the second chamber, and a step 1208 of blocking a movement of the piston with a stopping mechanism 1040 to prevent the piston 1010 from opening a port 1022.

An inner part 1022B of the port 1022 is formed in the piston 1010 and an outer part 1022A of the port 1022 is formed in the outer housing 1004. The piston 1010 is positioned to misalign the inner part and the outer part of the port 1022 so that there is no fluid communication between an inside and outside of the toe valve. The method may include a step of further increasing the pressure of the fluid to break the stopping mechanism. The method may also include a step of aligning the inner part of the port with the outer part of the port. The method may still include a step of achieving fluid communication between an interior and exterior of the toe valve through the port. In one application, the stopping mechanism includes a shear pin. In another application, the stopping mechanism includes plural shear pins, each one being manufactured to break at a different pressure.

One or more of the fluids used in the above embodiments may be a viscous fluid, for example, water mixed with a chemical. A length of the toe valves discussed above may be about 50 inches. Those skilled in the art would understand that longer or shorter toe valves may be used. A working pressure for the fluid inside the inner housing (the toe valve) may be about 7,000 psi when no pumping is used. When pumping is applied, the pressure may increase to about 10,000 psi. A pressure for breaking the burst disc may be about 12,000 psi and a pressure for breaking a shear pin may be about 14,000 psi. If plural shear pins are used, they may be designed to break successively, at about 12,000, 13,000 and 14,000 psi when three pins are used. In one embodiment, the pressures for breaking the shearable elements may be selected to be 60% and 80% of a maximum pressure that is applied to the well. By applying a certain pressure to the bore of the inner housing, and due to the various stages that are present in the toe valve, a pressure to be applied to the one or more pistons (sleeves) in such a toe valve may take a value that is different than the bore pressure. In other words, by applying a bore pressure $P_A$, the actual pressures that act on the plural pistons are $P_i$, which are different from $P_A$. In another embodiment, an actuation pressure (i.e., the pressure that breaks the disk) may overcome the shearable elements. However, the one or more pistons still may be stopped from opening the ports by lowering the pressure inside the bore below a given threshold (for example, between the actuation pressure and the hydrostatic pressure). Stopping the pistons is possible because of the restriction elements, which do not allow a quick pressure equalization on the two sides of them. Those skilled in the art would understand that these pressures are exemplary and not intended to limit the discussed embodiments.

The disclosed embodiments provide methods and systems for stopping and starting a process of opening a port in a toe valve while located in a well. It should be understood that this description is not intended to limit the invention. On the contrary, the exemplary embodiments are intended to cover alternatives, modifications and equivalents, which are included in the spirit and scope of the invention as defined by the appended claims. Further, in the detailed description of the exemplary embodiments, numerous specific details are set forth in order to provide a comprehensive understanding of the claimed invention. However, one skilled in the art would understand that various embodiments may be practiced without such specific details.

Although the features and elements of the present exemplary embodiments are described in the embodiments in particular combinations, each feature or element can be used alone without the other features and elements of the embodiments or in various combinations with or without other features and elements disclosed herein.

This written description uses examples of the subject matter disclosed to enable any person skilled in the art to practice the same, including making and using any devices or systems and performing any incorporated methods. The patentable scope of the subject matter is defined by the claims, and may include other examples that occur to those skilled in the art. Such other examples are intended to be within the scope of the claims.

What is claimed is:

1. A downhole tool for connecting an interior of a casing to a formation, the downhole tool comprising:

an inner housing extending along a longitudinal axis X;

an outer housing that encloses the inner housing and forms first to fourth chambers;

a first piston that separates the first and second chambers;

a second piston that separates the third and fourth chambers;

a port that is configured to fluidly communicate an outside and inside of the downhole tool;

a stopping mechanism that prevents the second piston from opening the port; and a first constrictor region formed between the second chamber and the third chamber, wherein the constrictor region is configured to allow a small content of a second fluid, present in the second chamber, to enter the third chamber, which is filled with air, and wherein the second piston is positioned to separate the port into an outer portion and an inner portion to interrupt a fluid communication between the outside and inside of the downhole tool.

2. The downhole tool of claim 1, wherein the stopping mechanism includes a shearable element.

3. The downhole tool of claim 2, wherein the shearable element is a shear pin that is attached to the inner housing.

4. The downhole tool of claim 2, wherein the shearable element is a shear pin that is attached to the outer housing.

5. The downhole tool of claim 1, wherein the first constrictor region prevents a sudden movement of the second piston.

6. The downhole tool of claim 1, further comprising:

a second constrictor region formed between the fourth chamber and a fifth chamber, wherein the second constrictor region is configured to allow a small content of a third fluid, present in the fourth chamber, to enter the fifth chamber, which is filled with air.

7. The downhole tool of claim 6, further comprising:

a third constrictor region located between the first piston and the second piston, the third constrictor region defining two more chambers, each chamber of the two more chambers holding a corresponding piston that is different from the first or second piston.

8. A downhole tool for connecting an interior of a casing to a formation, the downhole tool comprising:

an inner housing extending along a longitudinal axis X;

an outer housing that encloses the inner housing;

a piston that forms first and second chambers with the outer housing;

a port that fluidly communicates an outside and inside of the downhole tool; and a stopping mechanism that prevents the piston from opening the port, wherein an inner part of the port is formed in the piston and an outer part of the port is formed in the outer housing and the piston is positioned to misalign the inner part and the outer part so that there is no fluid communication between an inside and outside of the downhole tool, and wherein the port extends only through the outer housing and the piston.

9. The downhole tool of claim 8, wherein the piston comprises:

a burst disc that fluidly separates a fluid inside the inner housing from the first chamber.

10. The downhole tool of claim 8, wherein the piston is in direct contact with a fluid inside the inner housing.

11. The downhole tool of claim 8, wherein the stopping mechanism includes a shearable element.

12. The downhole tool of claim 11, wherein the shearable element is a shear pin that is attached to the inner housing.

13. Toe downhole tool of claim 12, wherein the shear pin breaks when a pressure of a fluid inside the inner housing is larger than a threshold pressure.

14. The downhole tool of claim 8, wherein the inner part of the port is aligned with the outer part of the port after the piston breaks the stopping mechanism.

15. The downhole tool of claim 8, further comprising:

a constrictor region located between the second chamber and a third chamber and configured to allow a small amount of air, present in the second chamber, to enter the third chamber, which is also filled with air.

16. A method for connecting an interior of a casing to a formation with a downhole tool that is placed in a well, the method comprising:

increasing a pressure of a fluid to break a burst disc formed into a piston of a tow valve, the piston being housed by an inner housing of the tow valve and an outer housing, wherein the inner housing forms with the outer housing, which encloses the inner housing, first and second chambers;

moving the piston, which separates the first and second chambers, toward the second chamber; and blocking a movement of the piston with a stopping mechanism to prevent the piston from opening a port, wherein an inner part of the port is formed in the piston and an outer part of the port is formed in the outer housing and the piston is positioned to misalign the inner part and the outer part so that there is no fluid communication between an inside and outside of the downhole tool, and wherein the port extends only through the outer housing and the piston.

17. The method of claim 16, further comprising:

further increasing the pressure of the fluid to break the stopping mechanism.

18. The method of claim 17, further comprising:

aligning the inner part of the port with the outer part of the port.

19. The method of claim 18, further comprising:

achieving fluid communication between an interior and exterior of the downhole tool through the port.

20. The method of claim 16, wherein the stopping mechanism includes a shearable element.

21. The method of claim 20, wherein the shearable element is a shear pin that is attached to the inner housing.

22. The method of claim 16, wherein the stopping mechanism includes plural shear pins, each one being manufactured to break at a different pressure.

23. The method of claim 16, further comprising:

slowing a movement of the piston by using a constrictor region between the second chamber and a third chamber.

* * * * *